US012053072B2

(12) United States Patent
Samain

(10) Patent No.: US 12,053,072 B2
(45) Date of Patent: Aug. 6, 2024

(54) HAIR TREATMENT PROCESS

(71) Applicant: L'OREAL, Paris (FR)

(72) Inventor: Henri Samain, Chevilly LaRue (FR)

(73) Assignee: L'OREAL, Paris (FR)

( * ) Notice: Subject to any disclaimer, the term of this patent is extended or adjusted under 35 U.S.C. 154(b) by 397 days.

(21) Appl. No.: 17/281,061

(22) PCT Filed: Oct. 1, 2019

(86) PCT No.: PCT/EP2019/076639
§ 371 (c)(1),
(2) Date: Mar. 29, 2021

(87) PCT Pub. No.: WO2020/070157
PCT Pub. Date: Apr. 9, 2020

(65) Prior Publication Data

US 2021/0368957 A1 Dec. 2, 2021

(30) Foreign Application Priority Data

Oct. 2, 2018 (FR) ..... 1859116

(51) Int. Cl.
*A45D 19/00* (2006.01)
*A45D 19/08* (2006.01)
(Continued)

(52) U.S. Cl.
CPC ..... *A45D 19/005* (2021.01); *A45D 19/0066* (2021.01); *A45D 19/08* (2013.01);
(Continued)

(58) Field of Classification Search
CPC .. A45D 19/005; A45D 19/0066; A45D 19/08; A45D 19/12; E03C 1/046; E03C 1/055
(Continued)

(56) References Cited

U.S. PATENT DOCUMENTS 1,693,248 A 11/1928 Newton
2,033,812 A 3/1936 Brewer
(Continued)

FOREIGN PATENT DOCUMENTS

EP 0131838 A2 1/1985
EP 1954893 A2 8/2008
(Continued)

OTHER PUBLICATIONS

Japanese Patent Office issued for Japanese Pat. App. No. 2021-518123 mailed Jun. 6, 2022 (7 pages).
(Continued)

*Primary Examiner* — Tuan N Nguyen
(74) *Attorney, Agent, or Firm* — Shumaker, Loop & Kendrick, LLP

(57) ABSTRACT

A process for treating, especially for washing, the hair, including applying at least one cosmetic active ingredient to the head of hair using a dispensing device. The dispensing device including a hand piece preferably having at least two nozzles, the jets of which collide with one another, to form a mixture of water and of the active ingredient, this mixture originating from a collection basin arranged below the user's head.

16 Claims, 5 Drawing Sheets

(51) Int. Cl.
*A45D 19/12* (2006.01)
*E03C 1/046* (2006.01)
*E03C 1/05* (2006.01)

(52) U.S. Cl.
CPC ..... *A45D 19/12* (2013.01); *E03C 1/046* (2013.01); *E03C 1/055* (2013.01)

(58) Field of Classification Search
USPC ..... 4/515–523, 567, 569–570, 615–616; 239/265.17, 410, 418, 422, 426, 433
See application file for complete search history.

(56) References Cited

U.S. PATENT DOCUMENTS

| | | | | |
|---|---|---|---|---|
| 2,076,688 | A * | 4/1937 | West | A47L 15/0086 4/518 |
| 2,807,269 | A | 9/1957 | Lembo | |
| 4,376,441 | A | 3/1983 | Duncan | |
| 4,792,250 | A * | 12/1988 | Turner | E03C 1/046 401/289 |
| 5,551,453 | A | 9/1996 | Sturla et al. | |
| 6,205,597 | B1 * | 3/2001 | Shimizu | A45D 19/08 4/518 |
| 6,402,776 | B1 * | 6/2002 | Martin | A61H 9/00 4/516 |
| 6,955,176 | B2 | 10/2005 | Ackermans et al. | |
| 2005/0087631 | A1 * | 4/2005 | Ursic | B05B 1/04 239/418 |
| 2015/0128983 | A1 | 5/2015 | Vic et al. | |
| 2016/0051025 | A1 | 2/2016 | Rollat-Corvol et al. | |

FOREIGN PATENT DOCUMENTS

| | | | | |
|---|---|---|---|---|
| ES | 2393548 | T3 | 12/2012 | |
| FR | 2931644 | A1 | 12/2009 | |
| FR | 2931665 | A1 | 12/2009 | |
| FR | 3061498 | A1 | 7/2018 | |
| JP | S-6036009 | A | 2/1985 | |
| JP | H0291654 | U | 7/1990 | |
| JP | H07-275751 | A | 10/1995 | |
| JP | 3097586 | U | 1/2004 | |
| JP | 2006-158529 | A | 6/2006 | |
| JP | 2015-113287 | A | 6/2015 | |
| JP | 5955297 | B2 | 7/2016 | |
| KR | 20160102597 | A | 8/2016 | |
| TW | I-616159 | B | 3/2018 | |
| WO | 0027240 | A1 | 5/2000 | |
| WO | WO-2004101163 | A1 * | 11/2004 | B05B 1/185 |
| WO | 2009145400 | A1 | 12/2009 | |
| WO | 2014154889 | A1 | 10/2014 | |

OTHER PUBLICATIONS

Indian First Examination Report issued for Indian Pat. App. No. 202117013569 mailed May 26, 2021 (5 pages.).
Japanese Patent Office issued for Japanese Pat. App. No. 2021-518130 mailed Mar. 8, 2022 (6 pages).
Indian First Examination Report issued for Indian Pat. App. No. 202117014594 mailed Jul. 30, 2021 (5 pages).
International Search Report for PCT/EP2019/076642 mailed Nov. 11, 2019 (3 pages).
Written Opinion for PCT/EP2019/076642 mailed Nov. 11, 2019 (6 pages).
International Search Report for PCT/EP2019/076624 mailed Nov. 6, 2019 (3 pages).
Written Opinion for PCT/EP/2019/076624 mailed Nov. 6, 2019 (5 pages).
International Search Report for PCT/EP2019/076639 mailed Nov. 11, 2019 (4 pages).
Written Opinion for PCT/EP2019/076639 mailed Nov. 11, 2019 (6 pages).
International Search Report for PCT/EP2019/076634 mailed Nov. 6, 2019 (3 pages).
Written Opinion for PCT/EP2019/076634 mailed Nov. 6, 2019 (5 pages).
Unity of Invention Requirement issued for U.S. Appl. No. 17/281,037, mailed Sep. 22, 2023 (6 pages).
Unity of Invention Requirement issued for U.S. Appl. No. 17/281,074, mailed Feb. 26, 2024 (7 pages).
Non-Final Office Action (NFOA) for U.S. Appl. No. 17/281,037, mailed Dec. 14, 2023 (11 pages).
Final Rejection issued for U.S. Appl. No. 17/281,037, mailed Jun. 12, 2024 (9 pages).

* cited by examiner

HAIR TREATMENT PROCESS

TECHNICAL FIELD AND BACKGROUND

The present invention relates to hair treatment processes and more particularly, but not exclusively, to processes for washing the hair. The invention also relates to devices for carrying out such processes.

In numerous situations, it would be desirable to reduce the amount of surfactant used to wash the hair. However, it is difficult to reduce the amount of surfactant in a shampoo without creating a problem of discomfort for the user. The product does not foam enough, which creates several problems; in particular, it becomes more difficult to see where the shampoo is on the head of hair, leading to a risk that areas of the hair such as the roots are poorly washed; moreover, this can cause dissatisfaction because it is generally desirable to see the foam develop, which is synonymous with effective washing.

It is also difficult to reduce the amount of product to apply because the same problems as above are observed.

Consequently, at least 15% by weight, or even up to 30% of surfactant is traditionally used in a shampoo, and for each washing operation, significant amounts such as 12 g of surfactant are used, these amounts being even higher since two washing operations are often carried out. Thus, it is generally possible to use, for each wash, up to 20 g of shampoo with 20% of surfactant, i.e. approximately 4 g of surfactant.

Moreover, this need for foam has led manufacturers to use the most foaming surfactants in shampoos. In some situations, these surfactants make the hair rough.

Thus, it would be desirable to use other surfactants, such as nonionic surfactants or natural surfactants. However, these surfactants do not foam very much. Thus, it is necessary to increase the concentrations and/or amounts of these surfactants, which goes against the goal of reducing the amount of surfactant.

Another approach for decreasing the amount of surfactant used consists in spacing the washing operations apart. However, this is not suitable for many people who want to wash their hair every day. Thus, a person may commonly use more than 1 kg of surfactant per year.

SUMMARY

There is therefore an unresolved need to create an effective hair washing system using less surfactant and able to work with surfactants other than anionic surfactants, such as nonionic surfactants. More generally, there is a need to reduce the consumption of certain active ingredients during hair treatments, in particular all the active ingredients that are diluted in water during their use or those that are applied while the user is at the washbasin.

The invention aims to meet this need and achieves this by virtue of a process for treating, especially for washing, the hair, comprising the steps consisting in:

a) applying at least one cosmetic active ingredient to the head of hair, especially a surfactant, b) applying to the head of hair, using a dispensing device preferably comprising at least two nozzles, the jets of which collide with one another, a mixture of water and of said active ingredient, this mixture originating from a collection basin arranged below the user's head.

"Originating from the collection basin" should be understood to mean that, during step b), the liquid dispensed by the hand piece has been previously collected by the collection basin. The liquid may be withdrawn directly from the basin or may be withdrawn from a buffer tank into which the contents of the tank runs.

"Cosmetic active ingredient" means a compound which has a hygiene, care, makeup or coloring effect contributing toward the improvement, well-being and/or enhancement or modification of the appearance of the human keratin material, especially of the hair and the scalp, onto which said active ingredient is applied.

Among the cosmetic active ingredients able to be applied to human keratin materials such as the scalp or the hair, mention may for example be made, alone or in mixtures, of surfactants, compounds for dyeing or bleaching the hair, compounds for permanently changing the shape of the hair, hair care active ingredients such as cationic polymers, fatty substances such as fatty alcohols, scalp care active ingredients such as antidandruff agents, anti-hair loss agents and fragrances.

The invention makes it possible to recycle the active ingredient that has run into the collection basin and thus to increase the number of passages of the active ingredient through the head of hair and/or the contact time thereof with the hair, and thus to increase the effectiveness thereof, making it possible to reduce the amount of active ingredient used for the same result.

The invention is most particularly useful when said active ingredient is a surfactant used for washing the hair, because recycling contributes to foam formation, which is generally sought after by hairdressers, as explained above.

In step a) above, the active ingredient may initially be applied in the form of a mixture of water and of said active ingredient. It is then particularly advantageous for this mixture to be dispensed onto the head of hair using the hand piece, operating with fragmentation of the jets under pressure and at a low flow rate. The mixture of water and of active ingredient may originate from a tank containing same, or as a variant may be formed by injection of said active ingredient into a clean water inlet, this injection preferably being metered. The mixture of water and active ingredient may also originate from a buffer tank in which it was stored at the end of a previous operating phase.

The dispensing device is preferably arranged to operate according to at least 2 modes, namely a first mode in which it dispenses a fluid without recycling, and a second mode in which it dispenses, with recycling, a fluid withdrawn from the collection basin. The passage from the first mode to the second may occur automatically, for example by virtue of a time delay or of a measurement of the amounts dispensed.

The dispensing device may comprise a pump to provide pumping and recirculation towards the handpiece and also one or more routing elements to direct the flows to the desired destination. The dispensing device may comprise any electronic control circuit, especially containing a microcontroller, capable of controlling the operation of the pump and of the routing element(s), the latter comprising for example solenoid valves. The dispensing device may also comprise sensors such as flowmeter, level sensor, pressure sensor, current sensor, turbidity sensor, temperature sensor, etc., which are useful for adjusting the flow rates and/or amounts dispensed.

The fluid dispensed in the first mode of operation may be a mixture of water and said active ingredient. In this case, the whole dispensing of the active ingredient during the different phases of the treatment is carried out automatically. This mode of implementation is said to be "automatic".

As a variant, the fluid dispensed in the first mode of operation is water, and the surfactant is applied in this case beforehand to the head of hair, differently to with the device in step a), being for example applied manually in the diluted state to the head of hair. This mode of implementation is said to be "semi-automatic".

In the automatic mode of operation in particular, the mixture of water and surfactant dispensed may originate from a tank containing the mixture and in which the latter is withdrawn by means of a pump, the capacity of this tank being for example between 100 and 10 000 ml or from a tank containing clean water, the surfactant then being injected into the water pumped into this tank. This injection can be carried out for example by Venturi effect, using a metering pump, a mixing chamber, or by pressurization, for example mechanical, of the tank containing the active ingredient. In the case of a mixing chamber, the tank containing the active ingredient is arranged so as to be passed through by the flow of water.

The mixture may also originate from a supply under pressure, for example a network of running water, in which at least one pure or diluted surfactant is injected, this injection being able to be carried out as above.

Preferably, the device comprises a fluid circuit comprising one or more routing elements such as multi-way valves or solenoid valves, for either withdrawing the liquid contained in the collection basin to return it using the pump under pressure to the nozzles, or to convey it to a drain. The device then preferably comprises, as mentioned above, an electronic control circuit for controlling the various components constituting it, and in particular for controlling the operation of the pump and also that of the routing element(s) which provide the change in the circulation of the flow between the different modes of operation.

The duration of the phase during which recycled liquid withdrawn from the collection basin is conveyed to the hair may be manually controlled, for example by a control member present for example on the hand piece bearing the nozzles. This allows the hairdresser to continue the recirculation for the necessary time until a result is obtained that he or she deems to be satisfactory.

As a variant, the duration of this recirculation phase is controlled automatically, for example as a function of a time delay, of the measurement of the amount recycled, or of a sensor delivering a signal representative of the activity of the active ingredient or of a parameter of the circulating water, for example the loading of impurities therein.

The flow rate of liquid originating from the collection basin may be constant or variable, and change according to a predefined rule if appropriate. Thus, the recirculation pump can operate at a variable speed, if appropriate.

The device may be arranged to pass into a third mode of operation, after the end of the recycling of the liquid originating from the collection basin, in which water without said active ingredient is conveyed onto the head of hair in order to rinse it. The passage into this rinsing mode may be automatic, as soon as the recycling ends, or be manually controlled, by action of the user on a control member.

It is further possible to arrange the device to enable an injection of water into the recycled liquid in order to decrease the content of active ingredient in the flow sent back towards the head of hair, and to gradually rinse the hair. This phase of operation can be followed by a rinsing phase in which water without active ingredient is conveyed to the nozzles.

Preferably, the dead volume Vt of liquid present in the nozzle supplying circuit, and especially the dead volume of the recirculation circuit, is minimized. Thus, in order to supply the hand piece and the suction of the pump, use is preferentially made of small-diameter piping, such as 3 to 5 mm of internal diameter, which gives for example, for a piping 1 m in length, a dead volume of approximately 90 mL.

The flow rate of the flow dispensed by the hand piece of the dispensing device is preferably less than or equal to 6 l/min, and more preferentially less than or equal to 4 l/min. For such a flow rate of less than or equal to 6 L/min, reference is made to a low-flow dispensing device.

In an exemplary implementation, water is dispensed onto the hair with the active ingredient which is a surfactant and then, when the dispensed volume has exceeded a total volume corresponding to the sum of the volume Va absorbed by the hair and the dead volume Vt contained in the supply lines of this mixture, that is to say from the suction in the collection basin to the outlet of the nozzles, the recirculation of the liquid contained in the collection basin is activated, especially automatically, and the supply of clean water and of active ingredient of the device is stopped.

Thus, with Va=110 mL and Vt=90 mL, the device no longer consumes active ingredient after having dispensed 200 ml of mixture. Recycling causes the surfactant to foam up and enables the hairdresser to target all areas of the head of hair, and in particular those which he or she cannot access at first. With a flow rate set at 2 L/min, the first phase corresponds to approximately 6 s. The second phase of recirculation can last longer, for example 20 s or more, because the device is then consuming neither water nor active ingredient.

Preferably, when the active ingredient is a surfactant, the amount of surfactant introduced into the water ranges from 0.075% to 0.75% by weight of surfactant relative to the total weight of the water and surfactant mixture. For example, 0.5 to 5% by weight of a shampoo with 15% surfactant is introduced into the water.

The amount of surfactant used for a wash preferentially ranges from 0.15 g to 1.5 g.

The content of surfactant in the mixture can be chosen according to the length of the hair, the degree of soiling, the temperature and/or the nature of the surfactant, among others. The abovementioned control circuit may be arranged to make it possible to adjust the content of surfactant, either manually or automatically, as a function, for example, of one or more items of data entered by the user, for instance the length of the hair. Preferably, the control circuit is arranged to store the settings specific to the person being treated in memory, so as to allow them to be recalled during a subsequent use.

In an example of a more comfortable implementation, the mixture of water and surfactant is dispensed and then, when the volume dispensed has exceeded a total volume $V_F$ corresponding to Va+Vt+Vs, where Vs denotes an additional volume, the recirculation is activated, especially automatically, and the supply of water and surfactant is stopped. Vs may range from 10 ml to 100 ml. Thus, with Va=110 mL, Vt=90 mL and Vs=100 mL, the device no longer consumes active ingredient after having dispensed 300 ml. With a flow rate set at 2 L/min, the first phase corresponds to approximately 9 s.

Preferably, the amount of surfactant introduced into the water ranges from 0.075% to 0.75% by weight of surfactant relative to the total weight of the water and surfactant mixture. This corresponds to a content of shampoo injected into the water ranging from 0.5 to 5% by weight, for a shampoo having a content by weight of 15% of surfactant. As above, the amount injected depends on the desired result and the condition of the hair. The amount of surfactant used for the wash ranges from 0.225 g to 2.25 g.

In an example of an even more comfortable implementation, the water is dispensed with surfactant and then, when the total volume dispensed $V_F$ has exceeded the volume Va absorbed by the head of hair, the device for recirculating the liquid from the collection basin is activated and the supply of water and surfactant is reduced, by maintaining it, deactivating it and then reactivating it according to the hairdresser's wishes, to convey a volume Vc. Thus, with Va=110 mL, Vt=90 mL, Vs=50 mL and Vc=150 ml, the device consumes the equivalent of 400 mL of water and surfactant mixture.

With a flow rate set at 2 L/min, the first phase lasts approximately 9 s. Preferably, the amount of surfactant introduced into the water ranges from 0.075% to 0.75% by weight of surfactant in the mixture, or as previously approximately 0.5 to 5% by weight of shampoo containing 15% surfactant. The content is chosen as a function of the condition of the hair and the desired result. The amount of surfactant consumed ranges from 0.3 g to 3 g.

In general, with a device dispensing 2 L/min, it is possible to use between 0.2 and 5% by weight of shampoo, corresponding to between 0.03% and 0.75% by weight of surfactant. Use may be made of 100 g to 660 g of water, depending on the operating time of the device during the phase of supplying water and surfactant, preferentially between 3 and 20 seconds for a flow rate of 2 L/min.

With a device set at 2 L/min, a supply with a mixture of water and surfactant containing 0.15% by weight of surfactant in the mixture, it is observed that, after 3 s, the hair is wet with the first 100 grams of water and surfactant mixture. The foam on the hair is poor.

Continuing for 3 s, the foam develops a little. The next 100 grams of the mixture run, are recovered in the collection basin and start being reinjected into the piping.

During the next 9 s, the foam increases and reaches a satisfactory level.

A final phase consists in stopping the recirculation and rinsing with clean water.

Summing up, the water consumption was 1.2 l and the surfactant consumption was 0.3 g.

In the semi-automatic mode, the surfactant is first applied to the hair. The water is dispensed without surfactant and then, when the volume of water dispensed has exceeded a total volume $V_F$ corresponding to the sum of the volume Va absorbed by the hair and the dead volume Vt, recirculation of the mixture is activated and the water supply is stopped. Thus, with Va=110 mL and Vt=90 mL, the device will have conveyed only 200 mL of water. Recirculation causes the surfactant to foam up and enables the hairdresser to target all areas of the head of hair, and in particular those which he or she cannot access at first.

With a flow rate set at 2 L/min, and applying a small amount of surfactant, lower than that which would be used for a normal shampoo, the recirculation of the water causes much more foaming than in a conventional procedure with the same amount of surfactant. The lower the amount of surfactant deposited, the longer the duration of the recirculation phase must be. It preferably lasts from 10 to 120 s.

Preferably, the amount of surfactant applied is from 0.075% to 0.75% of surfactant by weight relative to the total weight of the water and surfactant mixture, which corresponds to a content of 0.5 to 5% of shampoo in the mixture, assuming that the surfactant content of the shampoo is 15%. The amount of surfactant is chosen according to the case, as a function, for example, of the length of the hair, the soiling, the temperature and/or the nature of the surfactant, etc. The amount of surfactant used preferentially ranges from 0.15 g to 1.5 g.

As in the automatic mode, it can be arranged that the device dispenses water with surfactant from the start, before or after the application of the surfactant by hand. It may also convey clean water.

Another subject of the invention is a dispensing device for carrying out the process according to the invention, as defined above. This device may especially comprise all or some of the characteristics listed above, and in particular one or more of the following characteristics:

- the hand piece bears at least two nozzles, the jets of which collide with one another, these nozzles being supplied under pressure, preferably at a pressure of between 3 and 25 bar above atmospheric pressure;
- the dispensing device comprises a pump for supplying the hand piece under pressure;
- the device comprises at least one buffer tank towards which the contents of the collection basin may be drained, and at least one pipe to withdraw the contents of this buffer tank and recycle it towards the hand piece;
- the device comprises at least one first buffer tank and a second buffer tank and at least one first routing element for orienting the contents of the collection basin towards one or the other of said tanks, and at least one circuit for withdrawing the contents of a selected buffer tank in order to recycle it towards the hand piece, this circuit preferably comprising at least one second routing element for selecting the buffer tank, the contents of which it is desired to recycle;
- the device comprises at least one circuit for recycling the contents of the collection basin towards the hand piece and a circuit for draining to waste water, and a circuit for supplying water or a mixture of water and active ingredient, and at least one routing element for selectively activating at least one of said circuits;
- the device comprises a circuit for supplying water, a tank comprising the active ingredient, and at least one injection line for injecting the active ingredient contained in the tank into the water circulating in the water supply circuit, this injection line preferably being fitted with at least one valve, better still a solenoid valve;
- the device comprises a circuit for supplying water, at least one first tank comprising a first active ingredient, and at least one first injection line for injecting the active ingredient contained in this first tank into the water circulating in the water supply circuit, at least one second tank comprising a second active ingredient, and at least one second injection line for injecting the active ingredient contained in this second tank into the water circulating in the water supply circuit, each injection line preferably being fitted with at least one valve, better still a solenoid valve, the two active ingredients preferably being different surfactants;
- the device is arranged to operate according to two modes, namely a first mode in which it dispenses a fluid without recycling, and a second mode in which it dispenses a fluid withdrawn from the collection basin, the passage from the first mode to the second occurring automatically, especially by virtue of a time delay or of a measurement of the amounts dispensed;
- the device being arranged to pass into a third mode of operation, after the end of the recycling of the liquid originating from the collection basin, in which water without said active ingredient is conveyed onto the head of hair in order to rinse it, the passage into this third mode of operation preferably being automatic, as soon as the recycling ends, or being manually controlled, by action of the user on a control member;

the device is arranged to enable an injection of water into the recycled liquid in order to decrease the content of active ingredient in the flow sent back towards the head of hair, and to gradually rinse the hair.

Another subject of the invention is a system for treating the head of hair, especially for carrying out the process according to the invention as defined above, comprising:

a dispensing device preferably as defined above, comprising a hand piece, preferably comprising at least two nozzles, the jets of which collide with one another, this dispensing device comprising at least one pump for recycling, towards the hand piece, a liquid originating from a collection basin above which a user's head is arranged for the treatment of their head of hair.

The treatment system may further comprise the collection basin.

BRIEF DESCRIPTION OF THE FIGURES

The invention may be understood more clearly from reading the following detailed description of non-limiting exemplary embodiments thereof and from studying the appended drawing, in which.

DETAILED DESCRIPTION

Figure 1:
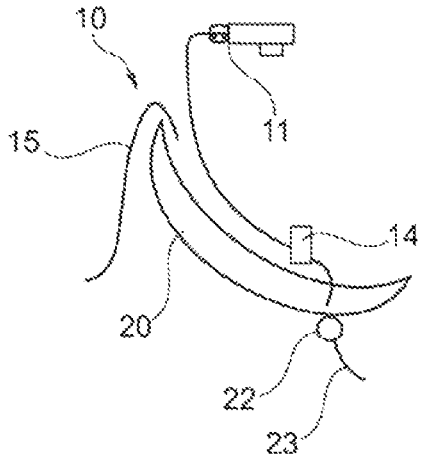
FIG. 1 is a schematic representation of an example of a washing device according to the invention.

FIG. 1 shows a treatment system according to the invention, comprising on the one hand a dispensing device 10 according to the invention, comprising a hand piece 11 resembling a shower head, and on the other hand a collection basin, also referred to as wash basin.

The collection basin may be of the same type as those used currently in hairdressing salons, being arranged to accommodate the user's head and enable the washing of their hair, the liquid poured onto the hair running into the basin by gravity.

The basin 20 can be produced from plastic.

It is arranged to channel the flow to a bung, the latter possibly being fitted with a siphon.

Figure 2:
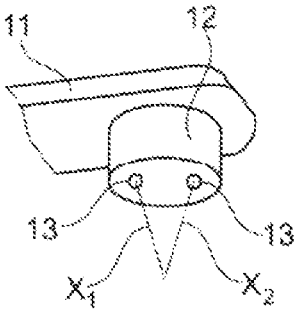
FIG. 2 is a partial schematic representation of a detail of the hand piece of the device of FIG. 1.

As can be seen in FIG. 2, the hand piece 11 comprises a handle enabling the user to hold it with one hand, and a dispensing head 12 provided with nozzles 13, which are arranged such that their jets encounter one another. Thus, the kinetic energy of the jets contributes to the fragmentation of the jets into drops. The nozzles are for example circular orifices 0.1 to 2 mm in diameter. The angle between the axes $X_1$ and $X_2$ of the nozzles is preferably between 30 and 120°, for example 45 or 90°. The nozzles 13 are supplied with pressurized liquid, so as to obtain a relatively high output jet speed, preferably greater than or equal to 10 km/h, better still at 20 km/h, for example of the order of 8 m/s.

The hand piece may be produced in accordance with the teaching of publication EP 1 954 893 B1 from Creaholic SA, which teaches generating a flow from two jets encountering one another.

Figure 12:
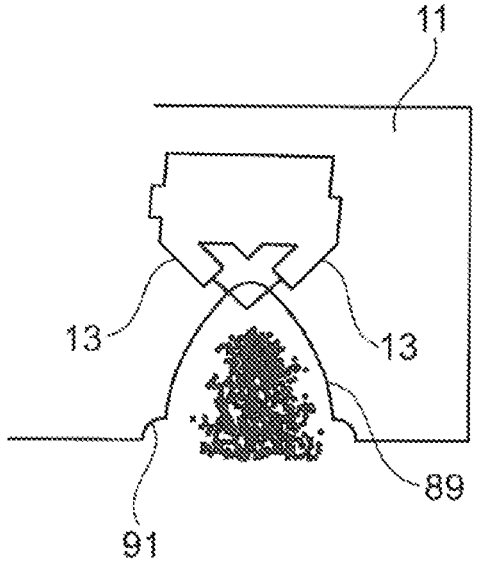
FIG. 12 shows an example of arrangement of the nozzles within the hand-piece.

The hand piece 11 may have a cavity 89 opened to the outside, within which the jets emitted by the nozzles 13 encounter one another, as illustrated in FIG. 12. This cavity 89 can diverge towards the outside, with a recess 91 further widening it in proximity to its opening. The cavity 89 can participate in guiding the flow generated after the encounter of the jets in the axis of said cavity, towards the outside.

The speed of the drops, measured at the opening of the cavity 89, in the axis thereof, can be greater than or equal to 8 m/s.

The dispensing device 11 comprises a pump 14, for example of centrifugal type.

The hand piece 11 is fed, in the example of FIG. 1, by this pump 14, such that the pressure upstream of the nozzles 13 is for example between 3 and 25 bar.

The basin 20 is fitted with a routing element 22, which makes it possible to direct the contents thereof towards a drain 23 for waste water when it is not desired to recycle it towards the pump 14.

The dispensing device 10 has a supply circuit 15, which may be a simple hose in one exemplary implementation of the invention, possibly provided with a supply valve.

In the example of FIG. 1, which is suitable for a semi-automatic implementation as defined above, the hose 15 is connected to a mains water supply, preferably a supply of clean water.

The hairdresser manually applies a shampoo to the head of hair. He or she may optionally foam it using their fingers. He or she then sends water into the collection basin 20, at an amount of 200 mL, for example using the hose 15, which in this example opens into the basin 20.

He or she then uses the hand piece 11 of the low-flow dispensing device, pumping the liquid into the collection basin 20. Due to the pressure and the fragmentation of the jets, the water foams on the head of hair. The fluid trickling into the basin 20 is recycled by pumping by virtue of the pump 14, to be dispensed on the head of hair by the hand piece. Satisfactory foam is observed. Thus, it is possible, compared to a conventional shampoo application, to use a smaller amount of product, possibly as little as 3 g instead of the usual 10, assuming a typical shampoo formulation based on 15% by weight of anionic surfactant of Lauryl Ether Sulfate type, relative to the total weight of the shampoo. When the user has obtained a satisfactory foam, after possible rubbing with the hands, he or she can use the hose 15 to rinse the hair or, better still, the hand piece 11. He or she must then, if they wish to use the hand piece 11, empty the collection basin 20 then re-close it, fill it with water, for example 1 l, and use the pump 14 to rinse the hair. He or she may then start this rinsing phase again as many times as necessary, by once again emptying the collection basin 20, re-closing it and starting the operation for pumping the water contained in the basin again, to pour it over the hair.

By comparison, if such an assembly was carried out without the dispensing device according to the invention but with a conventional head typically dispensing 10 L/min, it would be observed that it is not possible to reduce the amount of surfactant used, due to a lack of obtaining sufficient foam. The 3 g of shampoo used in the invention would not make it possible to obtain a good foam during the first phase and the second phase, during which the contents of the basin is returned towards the hand piece, would not amplify the foaming. Thus, the hairdresser would be inconvenienced by not obtaining an acceptable foam and would consider that they had not carried out satisfactory shampooing.

In the situations in which the hairdresser does not have a mains supply of water, he or she may pour water into the collection basin using another container such as a cup.

Figure 3:
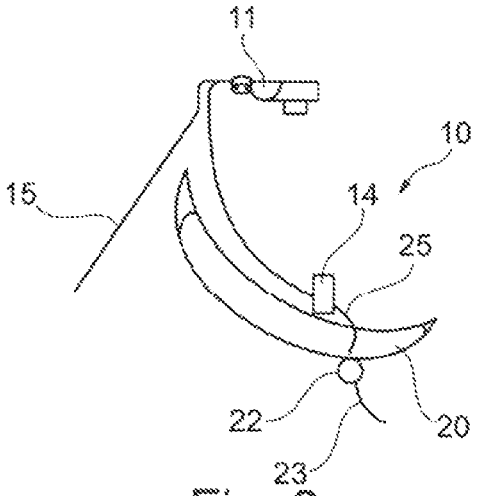
FIG. 3 is a similar to FIG. 2 of a varied embodiment.

In the example of FIG. 3, the device is improved by further providing for the hand piece 11 to have the possibility of receiving, in addition to the recycled fluid, water without surfactant. This variant is especially suitable for the abovementioned "automatic mode".

The hand piece 11 is thus connected firstly to the pump 14 which ensures the recycling and secondly to the supply 15 of mains water. A system of solenoid valves or valves (not shown) may be provided to make it possible to open or close the supply 15 and the pipe connecting the hand piece 11 to the pump 14, depending on the operating phase.

The hairdresser may apply a mixture of water and surfactant in the collection basin 20. He or she then uses the device 10 by dispensing, with the hand piece 11, the liquid pumped into the collection basin 20, for example via a hose 25 submerged in the basin, as illustrated, connected to the suction of the pump 14. The water which trickles from the head of hair into the basin 20 is then returned to the head of hair by pumping. It is observed that it is possible, compared to a conventional shampoo application, to use a smaller amount of product, possibly as little as 3 g instead of the usual 10. To carry out the rinsing, it is possible, without absolutely having to empty the collection basin, to rinse the hair with water originating from the supply 15.

Figure 4:
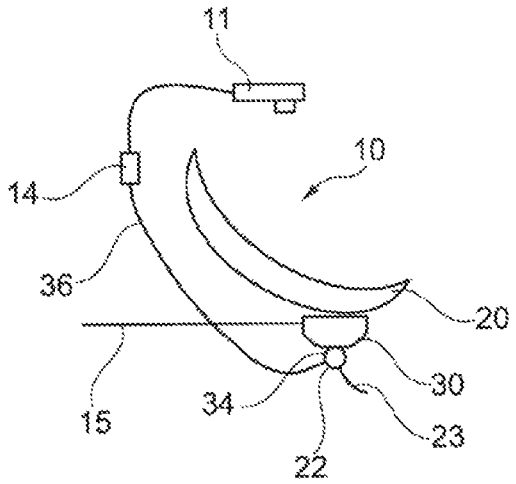
FIG. 4 is a similar to FIG. 2 of a varied embodiment.

The treatment system can be improved using two collection means, namely the basin 20 and a buffer tank 30 connected to the basin 20, such that the contents of the basin 20 flows into the tank 30 by gravity, as illustrated in FIG. 4.

Such a variant makes it possible to carry out the two processes, either semi-automatic or automatic, described above without risking the head of hair being soaked in water more or less loaded with surfactant present in the basin 20, which is advantageous for long heads of hair.

In the example of FIG. 4, the supply 15 of clean water opens into the buffer tank 30. A routing element 34, for example comprising one or more solenoid valves, makes it possible to have the bottom of the tank 30 communicate either with a pipe 36 connected to the suction of the pump 14, or with the waste water drain 23.

The volume of the buffer tank 30 is for example between 5 and 10 000 mL, preferably from 20 to 1000 mL.

Figure 5:
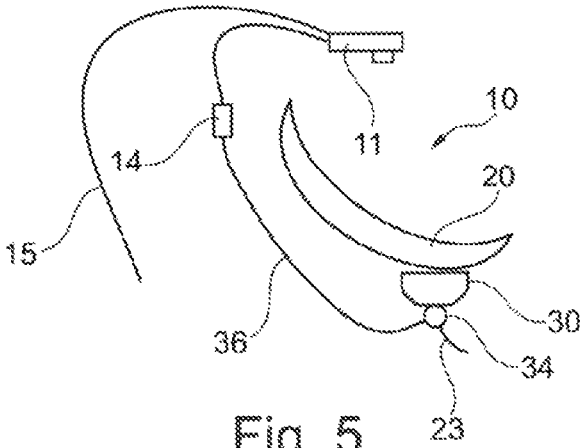
FIG. 5 is a similar to FIG. 2 of a varied embodiment.
Figure 6:
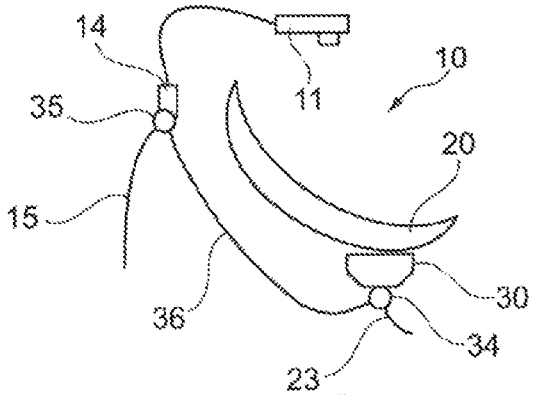
FIG. 6 is a similar to FIG. 2 of a varied embodiment.

In the variant of FIG. 5, the water supply 15 is connected to the hand piece 11. FIG. 6 shows the possibility of using the pump 14 to supply the hand piece 11 with water with or without surfactant.

The suction of the pump 14 is connected to a routing element 35 which makes it possible to either connect it to the water supply 15 or to the return pipe 36, communicating with the buffer tank 30 via the routing element 34.

To use the device 10 of FIG. 6, it is possible to start by placing water and surfactant in the collection basin 20 and/or the buffer tank 30, or applying the shampoo to the head of hair and controlling the routing element 35 to convey water to the head of hair, for example to dispense approximately 1 L thereon. The water dispensed wets the hair and is found in the buffer tank 30. Then, the device 10 is controlled to start the recycling of the water and surfactant mixture from the buffer tank 30 towards the hand piece 11. Foam then forms on the head of hair. After approximately 1 minute, the routing element 35 may be actuated to convey water without surfactant and rinse the hair. The amount of water conveyed is for example approximately 1.5 L. During this rinsing phase, the routing element 34 is also controlled to direct the liquid collected by the basin 20 towards the drain 23.

Preferably, the routing elements 34 and 35 are automatically controlled, for example by being connected to the same control system or to one another, in order to simplify the control thereof. In particular, the routing elements 34 and 35 and also the pump 14 may be placed in the same location, for example integrated in the same housing.

Figure 7:
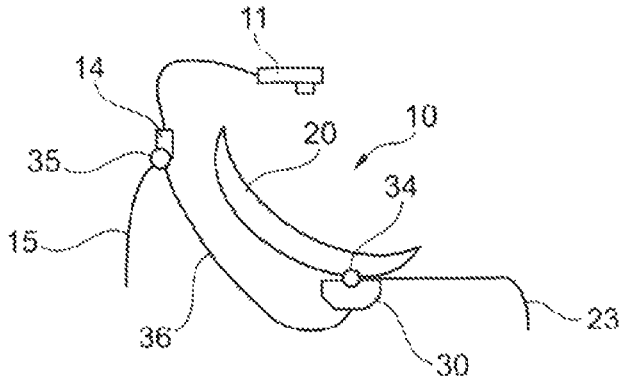
FIG. 7 is a similar to FIG. 2 of a varied embodiment.

In the example of FIG. 7, the routing element 34 is placed upstream of the buffer tank 30 and not downstream as is the case of the variant of FIG. 6. In this case, it makes it possible to orient the liquid flowing from the tank 20, either towards the buffer tank 30 or towards the drain 23.

This makes it possible to store the mixture of water and surfactant for a subsequent use, such as carrying out a "second round" of washing.

In the semi-automatic mode, the shampoo can be applied, and the routing element 35 can be actuated in order that the hand piece 11 sends water, for example in an amount of 1 L. The routing element 34 is then controlled in order that the liquid can pass from the collection basin 20 to the buffer tank 30. The water dispensed by the hand piece 11 wets the hair and is located in the buffer tank 30. Then, the routing element 35 is actuated and the pump 14 turned on to pump the mixture of water and surfactant from the buffer tank 30 towards the hand piece 1L. Foam then forms on the head of hair. After approximately 1 minute, for example, the routing element 34 is actuated to connect the collection basin 20 to the drain 23. The routing element 35 is controlled to convey water without surfactant towards the hand piece 11, for example an amount of approximately 1.5 L. In doing so, the rinsing water is conveyed into the drain 23 and the mixture of water and surfactant is kept in the buffer tank 30. In a second step, the hairdresser can carry out a second washing operation by using the mixture present in the buffer tank 30.

Figure 8:
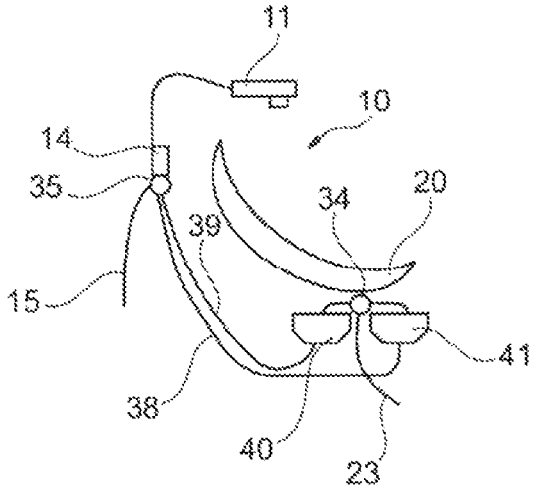
FIG. 8 is a similar to FIG. 2 of a varied embodiment.

Other implementations are possible with additional buffer tanks, for example to set aside certain mixtures of water and surfactants, as shown in FIG. 8. This is especially beneficial for treatments involving different surfactants, as explained below.

It is possible to dispense the surfactant required for the washing treatment via a controllable system for injecting this surfactant into a stream of water.

Figure 9:
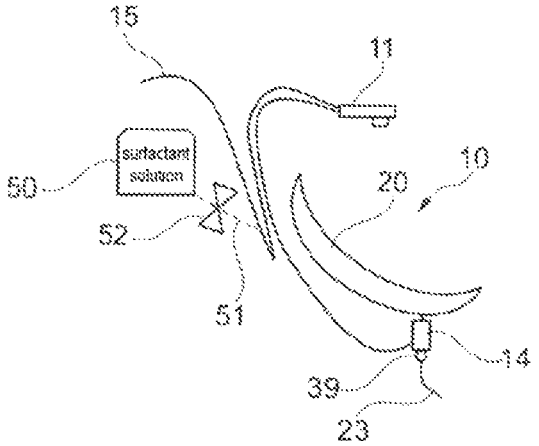
FIG. 9 is a similar to FIG. 2 of a varied embodiment.

In the example of FIG. 9, the device 10 comprises a tank 50 intended to receive this surfactant, in particular in the concentrated state. An injection line 51 makes it possible to dispense the contents of this tank into the water supply pipe 15. This injection line 51 is fitted with a valve 52 which makes it possible to control the amount injected. This valve 52 may be a solenoid valve.

The device 10 illustrated in FIG. 9 can be used in the following manner.

The user fills the tank 50 with a composition comprising a surfactant, the surfactant concentration of this composition ranging for example from 0.1% to 100% by weight relative to the total weight of the composition.

It is then possible to dispense a mixture of water and surfactant to the hand piece 11 by virtue of the injection of surfactant from the tank 50 into the stream of water arriving via the pipe 15.

Once the amount of water and surfactant dispensed is sufficient, for example approximately 200 ml, the recycling of the mixture of water and surfactant by means of the pump 14 can be started and the arrival of water via the pipe 15 and the injection of surfactant into the latter can be stopped.

At the end of the washing, it is possible to restart the arrival of water via the pipe 15 to carry out rinsing, but without restarting the injection of surfactant from the tank 50. The operation of the pump 14 is interrupted and the rinsing water is conveyed to the drain by opening a valve 39.

Figure 11:
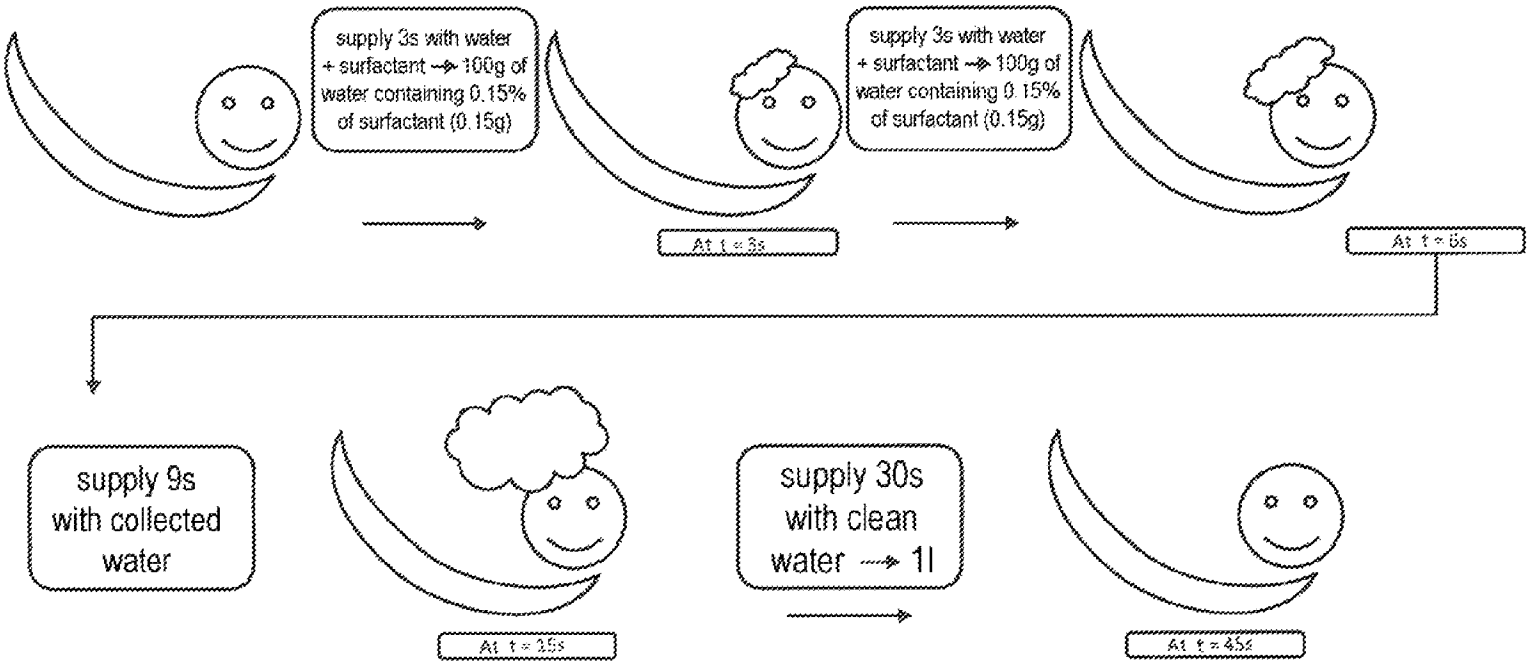
FIG. 11 illustrates various steps of an example of a treatment process according to the invention.

In the example illustrated in FIG. 11, with a device 10 set at 2 l/min, a supply with a mixture of water and surfactant containing 0.15% by weight of surfactant in the mixture, it is observed that, after 3 s, the hair is wet with the first 100 grams of water and surfactant mixture. The foam on the hair is poor.

Continuing for 3 s, the foam develops a little. The next 100 grams of the mixture run, are recovered in the collection basin 20 and start being reinjected towards the hand piece 11. During the next 9 s, the foam increases and reaches a satisfactory level.

It is then possible to stop the recirculation and rinse with clean water.

Summing up, the water consumption was 1.2 L and the surfactant consumption was 0.3 g.

Figure 10:
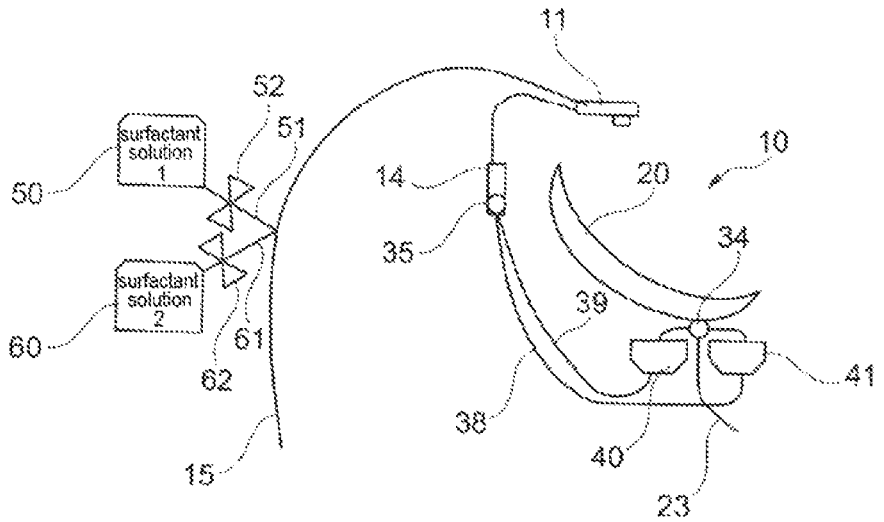
FIG. 10 is a similar to FIG. 2 of a varied embodiment.

In the exemplary implementation of FIG. 10, the device 10 comprises two tanks 50 and 60 intended to contain different active ingredients. Respective injection lines 51 and 61 are provided for injecting the contents of these tanks into the supply pipe 15. Each injection line 51 or 61 is fitted with a respective valve 52 or 62 which makes it possible to control this injection.

The device 10 comprises two buffer tanks 40 and 41 connected by two respective pipes 38 and 39 to the pump 14, via a routing element 35, which makes it possible to select one or the other.

The routing element 34 is placed upstream of the buffer tanks 40 and 41 and makes it possible to direct the drainage of the basin 20 to either the tank 40 or to the tank 41 or to the waste water drain 23.

It is possible to control the routing elements 34 and 35 such that the active ingredient originating from the tank 50 is stored in the buffer tank 40 and the active ingredient originating from the tank 60 is stored in the buffer tank 41. It is possible to generalize to n tanks 50*i* containing respective active ingredients and n buffer tanks 40*i* for storing the corresponding mixtures of water and active ingredient.

The invention makes it possible to use all sorts of surfactants, either natural, for example saponins, or polymeric. The surfactants may be:

anionic surfactants (sulfates, ether sulfates, sulfonic, carboxylic), amphoteric surfactants, nonionic surfactants, and mixtures thereof.

It is of note that the use of low-foaming formulations in the case of a conventional use nonetheless gives satisfactory results by virtue of the invention.

Use may also be made of cationic surfactants for their care effect, generally combined with fatty alcohols. In this case, the foaming is low but the process is especially advantageous for using a minimum amount of composition.

The invention may also be used for other formulations such as dyeing, permanent-waving or hair straightening products.

"Dyeing product" should be understood as any product of use for changing the color of the head of hair, especially in a lasting manner. This may be an oxidation dye, a direct dye or a dyeing oxidant.

The oxidation dye may be chosen from one or more oxidation bases optionally combined with one or more coupling agents.

By way of example, the oxidation bases are chosen from para-phenylenediamines, bis(phenyl)alkylenediamines, para-aminophenols, ortho-aminophenols and the corresponding addition salts.

By way of example, the coupling agents are chosen from meta-phenylenediamines, meta-aminophenols, meta-diphenols, naphthalene-based coupling agents and also the corresponding addition salts.

The dyeing oxidant may be chosen from hydrogen peroxide; urea peroxide; alkali metal ferricyanides or bromides; peroxygenated salts such as, for example, persulfates, perborates and percarbonates of alkali metals or alkaline earth metals, such as sodium, potassium and magnesium; or mixtures thereof.

The direct dye may be chosen from azo direct dyes; (poly)methine dyes such as cyanines, hemicyanines and styryls; carbonyl dyes; azine dyes; nitro(hetero)aryl dyes; tri(hetero)arylmethane dyes; porphyrin dyes; phthalocyanine dyes and natural direct dyes, alone or in the form of mixtures.

Permanent-waving or hair-straightening products may include compounds for permanently changing the shape of the hair.

The permanent-waving product may comprise one or more active ingredients chosen from thioglycolic acid or the salts thereof (ammonium thioglycolate, also referred to as TGA), derivatives of thiolactic acid or the salts thereof (ammonium thiolactate, also referred to as TLA), cysteine or the salts thereof and the derivatives thereof, cysteamine, the salts and derivatives thereof, sulfites, bisulfites and mixtures thereof.

The hair straightening product may comprise one or more active ingredients chosen from thioglycolic acid or salts thereof (ammonium thioglycolate, also referred to as TGA), derivatives of thiolactic acid or the salts thereof (ammonium thiolactate, also referred to as TLA), and strong bases such as sodium hydroxide, guanidine compounds and salts thereof, lithium hydroxide, potassium hydroxide and mixtures thereof.

When at least two different active ingredients are applied successively to the head of hair, especially with recirculation of at least one active ingredient, the process may comprise the following steps A and B, preferably recirculating the active ingredient at each step A or B:

A: Application of an anionic surfactant, then

B: application of a nonionic surfactant, which provides easy rinsing and soft hair;

or

A: Application of an anionic surfactant, then

B: application of a polymeric detergent or natural surfactant, which provides easy rinsing and very well-cleaned hair;

or

A: Application of an anionic surfactant, then

B: application of a cationic surfactant (with fatty alcohol), which provides easy rinsing and softened hair which is easy to disentangle;

or

A: Application of a carboxylic surfactant at alkaline pH, then

B: application of a surfactant (any type) at acid pH, which provides deep washing and shiny hair.

The invention thus makes it possible to carry out several rounds of washing. While in reality it is possible to carry out 2 or even 3 rounds of washing, it is difficult to go further, for practical reasons and for reasons of the amount of surfactant to be used. However, by virtue of automating the control of the routing elements in particular, the invention makes it possible to carry out 2, 3, 4, 5 or more rounds of washing.

EXAMPLES

Example 1

A treatment system according to the invention was used, in which the dispensing device 10 dispenses 2 l/min. To carry out the test, the device was used with a supply of clean water and a pump 14 set at 12 bar. A collection basin and a reserve of clean water formed for example of a tub filled with water are used. The device is similar to that shown in FIG. 1. The hose that will draw water from the collection basin is positioned at the lowest point of the collection basin.

The test takes place on a malleable head previously soiled with sebum. 1 g of sebum is used, spread over the whole head of hair.

As surfactant, use is made of a formula A comprising 15% by weight of LES (sodium lauryl ether sulfate) surfactant diluted in water.

| | |
|---|---|
| Lauryl ether sulfate at 70% in water (TEXAPON N702 from BASF) | 15% (AM) |
| Citric acid q.s. | pH 5.5 |
| Water q.s. | 100% |

Side Treated According to the Invention 2 g of the formula A are applied by hand to one half of the malleable head. The supply of the device 10 is then placed in the tub. The device is operated for 9 seconds to pour water over the head of hair. Then, the supply of the device is moved, placing it at the bottom of the basin 20. The device is restarted by starting the pump 14. The device is operated in this way for 30 seconds. The drain of the basin is then opened, and the supply of the device is replaced in the tub. Rinsing is carried out with water from the tub for 1 minute (i.e. 2 L of water).

Side Used as a Reference 4 g of the formula A are applied by hand to the other half of the malleable head. Foaming is then carried out by hand. The drain of the basin is then opened, and rinsing is carried out with a conventional jet of water for 1 minute, consuming approximately 10 L of water.

Result

Better foam was obtained on the side treated according to the invention, as well as satisfactory cleaning, since greasy areas are no longer observed, with a lower consumption of water.

Example 2

The same device is used as in example 1.

The test is carried out on a malleable head soiled in the same way. Use is made of a washing formula B:

| | |
|---|---|
| Lauryl ether sulfate at 70% in water (TEXAPON N702 from BASF) | 17% (AM) |
| Cocoyl betaine at 30% in water (Dehyton AB 30) | 3% (AM) |
| Citric acid q.s. | pH 5.5 |
| Water q.s. | 100% |

One half of the head is treated as in example 1.

By way of comparison, 2 g of the formula B are manually applied to the other half of the malleable head, and then the supply of the device is placed in the tub, setting it to reach 10 L/min. The device is operated for 9 seconds. Subsequently, the supply of the device is moved, placing it at the bottom of the collection basin 20. The device 10 is restarted by starting the pump. The device is operated in this way for 30 seconds, then the drain of the basin is opened, and the supply of the device is replaced in the tub. Rinsing is carried out for 1 minute with 2 liters of water.

Result

A better foam was obtained on the side treated according to example 1 as well as more efficient cleaning, which shows the advantage of dispensing the flow on the hair with a relatively low flow rate.

Example 3

The set-up of example 1 is produced.

The hairdresser applies formula A to the dry head of hair (2 g of formula A, i.e. 0.3 of surfactant LES). He or she then directs 300 ml of water to the head of hair, which arrives in part (about 200 mL) in the collection basin 20. He or she then uses the low-flow dispensing device, pumping the liquid present in the collection basin. After 30 seconds, abundant foam is obtained. After rinsing, the hair is observed to be well washed.

Example 4

Use is made of the treatment system as described in FIG. 3.

The following formula C is prepared:

| | |
|---|---|
| Lauryl ether sulfate at 70% in water (TEXAPON N702 from BASF) | 1% (AM) |
| Water q.s. | 100% |

The hairdresser applies 250 mL of formula C to the bottom of the basin, i.e. 2.5 g of LES surfactant. He or she then uses the low-flow dispensing device, pumping the liquid in the collection basin. After 22 seconds, abundant foam is obtained. Finally, rinsing is carried out.

Example 5: Wash/Care Protocol

Use is made of a malleable head of previously bleached hair, soiled beforehand with 2 g of sebum.

The following formulae D and E are produced:

| | |
|---|---|
| APG ALKYL (C8/C10/C12/C14 34/24/29/10) POLYGLUCOSIDE (1.4) IN AQUEOUS SOLUTION AT 53% (Plantacare 2000 UP (BASF 2% AM) | |
| Water q.s. | 100% |

| | |
|---|---|
| Behenyltrimethylammonium chloride (Genamin KDMP sold by Clariant) | 1% |
| Cetylstearyl alcohol (C16/C18 at the relative amount of 30/70) (sold by Industria Quimica del Centro) | 2% |
| White mineral oil | 1% |

-continued

| | |
|---|---|
| (Marcol 82 sold by Exxonmobil Chemicals) | |
| Citric acid q.s. | pH 4.5 |
| Water q.s. | 100% |

Use is made of the system from FIG. 8, with several buffer tanks.

Step 1: The hairdresser applies 250 ml of formula D to the bottom of the basin 20, i.e. 5 g of APG surfactant. He or she then uses the low-flow dispensing device 10, pumping into the basin, by virtue of the hose 15. After 15 seconds, abundant foam is obtained. He or she subsequently opens the bung of the basin and lets the water pass into the tank 40. He or she then rinses with 1 L of water.

Step 2: The hairdresser applies 250 mL of formula E to the bottom of the basin, i.e. 1.8 g of cationic surfactant. He or she then uses the low-flow device, pumping into the collection basin in the same way as in step 1. After 10 seconds, he or she obtains a perceptible effect of softness in the hair, which can be felt with the fingers. He or she subsequently continues for 50 seconds and opens the bung of the basin to let the water pass into the tank 41. He or she finally rinses with 1 L of water.

Step 1 and step 2 are subsequently started again, this time using the mixture stored in the corresponding buffer tank and by pumping into the latter.

Hair that is very well washed and easy to disentangle is obtained.

Example 6: Washing Protocol with Two Surfactants

Use is made of a malleable head of natural brown hair, soiled beforehand with 1 g of sebum.

The following formulae F and G are produced:

| | |
|---|---|
| Potassium hydroxide soap at 30% in water (sold by Auxi Chimique under the name Savon Liquide Base, and under the INCI name "Potassium hydroxide and sunflower seed acid and coconut acid") | 2% (AM) |
| MEA/Citric acid buffer q.s. | pH 10 |
| Water q.s. | 100% |

| | |
|---|---|
| Lauryl ether sulfate at 70% in water (TEXAPON N702 from BASF) | 2.5% (AM) |
| Coco betaine at 30% in water (Dehyton AB 30) | 2.5% (AM) |
| Citric acid q.s. | pH 5.5 |
| Water q.s. | 100% |

Use is made of the set-up of FIG. 9. The formula F is contained in the tank 50.

Step 1: The hairdresser applies 250 ml of formula F to the bottom of the basin, i.e. 5 g of soap. He or she then uses the low-flow dispensing device, pumping into the collection basin. After 15 seconds, relatively abundant foam is obtained. He or she then drains the contents of the basin towards the drain 23 and rinses with 1 L of water.

Step 2: The hairdresser starts the low-flow dispensing device again, injecting the formula G into the water at a dilution amount of 20% by weight. It thus dispenses 200 g of the mixture of water and formula G, i.e. 40 g of formula G and 2 g of surfactant.

He or she then stops the water arrival and the injection and starts the pump 14, which draws up the liquid in the collection basin 20 and returns it to the head of hair. After 20 seconds, very abundant foam is obtained. Finally, he or she opens the bung of the basin and rinses with 1 l of water.

Hair that is very well washed and easy to disentangle is obtained. Unlike the result usually obtained with soaps, the hair is not whitish or dull.

Example 7: Washing Protocol with a Lot of Foam

Use is made of a malleable head of previously bleached hair, soiled beforehand with 2 g of sebum.

Use is made of formula G from example 6, and formula H is produced:

| | |
|---|---|
| Cocoyl glutamate | 2% by weight |
| Water q.s. | 100% |

Use is made of the set-up of FIG. 3.

Step 1: The hairdresser applies 20 mL of formula G to the bottom of the basin, i.e. 1 g of surfactant to which he or she adds 200 mL of clean water. He or she stirs the mixture in order to homogenize, then uses the low-flow device, pumping into the water collection basin. After 10 seconds, average foam is obtained. He or she then continues for 50 seconds.

Step 2: The hairdresser applies 100 mL of formula H to the bottom of the basin, i.e. 2 g of cocoyl glutamate surfactant. He or she then uses the low-flow device, pumping into the water collection basin. After 15 seconds, very abundant foam is obtained. He or she then opens the bung of the basin and drains the contents thereof.

A treatment producing a lot of foam is obtained, despite using a small amount of surfactant.

The invention claimed is:

1. A process for treating hair, comprising:

a) applying at least one cosmetic active ingredient to the hair, b) applying to the hair, using a dispensing device comprising a hand piece comprising at least two nozzles, a mixture of water and of said active ingredient, said mixture originating from a collection basin arranged below the user's head jets of the at least two nozzles colliding with one another, the nozzles being supplied under pressure, at a pressure of between 3 and 25 bar above atmospheric pressure, the device being arranged to operate according to at least two modes, namely a first mode in which the device dispenses a fluid without recycling, and a second mode in which the device dispenses a fluid withdrawn from the collection basin, a passage from the first mode to the second occurring automatically.

2. The process as claimed in claim 1, the cosmetic active ingredient being chosen from surfactants, compounds for dyeing or bleaching the hair, compounds for permanently changing the shape of the hair, hair care active ingredients comprising cationic polymers, fatty substances comprising fatty alcohols, scalp care active ingredients comprising antidandruff agents, anti-hair loss agents and fragrances.

3. The process as claimed in claim 1, the active ingredient being a surfactant.

4. The process as claimed in claim 1, the dispensing device comprising a pump for supplying the hand piece under pressure.

5. The process as claimed in claim 1, further comprising at least one buffer tank, and at least one pipe to withdraw the contents of said buffer tank and recycle the contents towards the hand piece.

6. The process as claimed in claim 1, the device comprising at least one first buffer tank and a second buffer tank and at least one first routing element for orienting the contents of the collection basin towards one or the other of said tanks, and at least one circuit for withdrawing the contents of a selected buffer tank in order to recycle it towards the hand piece.

7. The process as claimed in claim 1, comprising at least one circuit for recycling the contents of the collection basin towards the hand piece and a circuit for draining to waste water, and a circuit for supplying water or a mixture of water and active ingredient, and at least one routing element for selectively activating at least one of said circuits.

8. The process as claimed in claim 1, wherein the device comprises a circuit for supplying water, a tank comprising the active ingredient, and at least one injection line for injecting the active ingredient contained in the tank into the water circulating in the water supply circuit.

9. The process as claimed in claim 1, wherein the device comprises a circuit for supplying water, at least one first tank comprising a first active ingredient, and at least one first injection line for injecting the active ingredient contained in this first tank into the water circulating in the water supply circuit, at least one second tank comprising a second active ingredient, and at least one second injection line for injecting the active ingredient contained in this second tank into the water circulating in the water supply circuit.

10. The process as claimed in claim 1, wherein water and the active ingredient are placed in the collection basin and then the recirculation of the collection basin towards the hand piece is started.

11. The process as claimed in claim 1, wherein, in step a), the active ingredient is initially applied in the form of a mixture of water and of said active ingredient.

12. The process as claimed in claim 1, the fluid dispensed in the first mode being water, the active ingredient, being applied beforehand to the hair.

13. The process as claimed in claim 1, the device being arranged to pass into a third mode of operation, after the end of the recycling of the liquid originating from the collection basin, in which water without said active ingredient is conveyed onto the hair in order to rinse the hair, as soon as the recycling ends, or being manually controlled, by action of the user on a control member.

14. The process as claimed in claim 1, the device being arranged to enable an injection of water into the recycled liquid in order to decrease the content of active ingredient in the flow sent back towards the hair, and to gradually rinse the hair.

15. A system for treating a head of hair, comprising:

a dispensing device comprising a hand piece, the dispensing device comprising at least two nozzles, jets of the at least two nozzles colliding with one another and the nozzles supplied under pressure of between 3 and 25 bar above atmospheric pressure, said dispensing device comprising at least one pump for recycling, towards the hand piece, a liquid originating from a collection basin and a user's head arranged above the collection basin for the treatment of their head of hair, the device being arranged to operate according to at least two modes, namely a first mode in which the device dispenses a fluid without recycling, and a second mode in which the device dispenses a fluid withdrawn from the collection basin, a passage from the first mode to the second occurring automatically.

16. The treatment system as claimed in claim 15, further comprising the collection basin.

* * * * *